US011773850B2

(12) United States Patent
Yamamoto et al.

(10) Patent No.: US 11,773,850 B2
(45) Date of Patent: Oct. 3, 2023

(54) ELECTRIC COMPRESSOR

(71) Applicant: KABUSHIKI KAISHA TOYOTA JIDOSHOKKI, Aichi-ken (JP)

(72) Inventors: Shiori Yamamoto, Aichi (JP); Yuya Hattori, Aichi (JP); Takumi Maeda, Aichi (JP); Shinji Koike, Aichi (JP); Takafumi Konishi, Aichi (JP); Keita Jinno, Aichi (JP); Ami Fujiwara, Aichi (JP)

(73) Assignee: KABUSHIKI KAISHA TOYOTA JIDOSHOKKI, Aichi-Ken (JP)

( * ) Notice: Subject to any disclaimer, the term of this patent is extended or adjusted under 35 U.S.C. 154(b) by 0 days.

(21) Appl. No.: 17/701,149

(22) Filed: Mar. 22, 2022

(65) Prior Publication Data

US 2022/0307501 A1 Sep. 29, 2022

(30) Foreign Application Priority Data

Mar. 25, 2021 (JP) ..... 2021-052142

(51) Int. Cl.

| | |
|---|---|
| ***F04C 18/02*** | (2006.01) |
| ***F04C 27/00*** | (2006.01) |
| ***F04C 23/00*** | (2006.01) |

(52) U.S. Cl.

CPC ..... *F04C 18/0215* (2013.01); *F04C 23/008* (2013.01); *F04C 27/005* (2013.01); (Continued)

(58) Field of Classification Search

CPC ..... F04C 18/0207–0292; F04C 23/008; F04C 2240/10; F04C 2240/30; F04C 2240/40; (Continued)

(56) References Cited

U.S. PATENT DOCUMENTS

2016/0108915 A1 4/2016 Deguchi et al.
2019/0301461 A1* 10/2019 Yamashita ..... F04C 29/0021
(Continued)

FOREIGN PATENT DOCUMENTS

JP 2014-231750 A 12/2014
JP WO2019044867 A1 3/2019
(Continued)

*Primary Examiner* — Mark A Laurenzi
*Assistant Examiner* — Xiaoting Hu
(74) *Attorney, Agent, or Firm* — Greenblum & Bernstein, P.L.C.

(57) ABSTRACT

An electric compressor includes a housing including a compression part housing, a shaft support housing, and a motor housing fastened by a plurality of fastening members. A peripheral wall has a plurality of thick-walled portions that protrudes inwardly in a radial direction and through which their associated fastening members are inserted. The fixed scroll base plate has a plurality of protruded portions each protruding outwardly in the radial direction and disposed between the thick-walled portions in a circumferential direction. The fixed scroll base plate has a plurality of pillar portions each extending from the protruded portions toward the shaft support housing in the axial direction and spaced from each other in the circumferential direction. The elastic plate is held at a plurality of spots by the plurality of pillar portions and the shaft support housing.

2 Claims, 3 Drawing Sheets

(52) U.S. Cl.
CPC ..... *F04C 2240/10* (2013.01); *F04C 2240/30* (2013.01); *F04C 2240/40* (2013.01); *F04C 2240/801* (2013.01); *F04C 2240/805* (2013.01)

(58) Field of Classification Search
CPC ..... F04C 2240/80; F04C 2240/801; F04C 2240/805; F04C 27/005
See application file for complete search history.

(56) References Cited

U.S. PATENT DOCUMENTS

| | | | | |
|---|---|---|---|---|
| 2020/0232463 | A1* | 7/2020 | Lee | F04C 18/0215 |
| 2020/0309127 | A1 | 10/2020 | Koike et al. | |

FOREIGN PATENT DOCUMENTS

| | | | | |
|---|---|---|---|---|
| JP | 2019-178674 | A | | 10/2019 |
| JP | 2019-178676 | A | | 10/2019 |
| JP | 2020-159314 | A | | 10/2020 |
| KR | 20090027417 | A | * | 3/2009 |
| KR | 1020130094653 | A | | 8/2013 |
| KR | 20200095693 | A | * | 8/2020 |

* cited by examiner

ELECTRIC COMPRESSOR

CROSS-REFERENCE TO RELATED APPLICATION

This application claims priority to Japanese Patent Application No. 2021-052142 filed on Mar. 25, 2021, the entire disclosure of which is incorporated herein by reference.

BACKGROUND ART

The present disclosure relates to an electric corepressor.

Japanese Patent Application Publication No. 2020-159314 discloses a conventional electric compressor. This compressor includes a housing, a fixed scroll, a movable scroll, a drive shaft, and an electric motor. The housing has an intake chamber, and an intake port through which fluid is drawn into the intake chamber. The drive shaft is rotatably supported in the housing. The fixed scroll includes a fixed scroll base plate, and a fixed scroll wall extending from the fixed scroll base plate. The fixed scroll is fixed to the housing. The movable scroll includes a movable scroll base plate facing the fixed scroll base plate, and a movable scroll wall extending from the movable scroll base plate. The movable scroll wall is meshed with the fixed scroll wall. The movable scroll is connected to the drive shaft and supported in the housing so as to make an orbital motion around an axis of the drive shaft, and a compression chamber is defined between the movable scroll and the fixed scroll. In this electric compressor, the volume of the compression chamber reduces with the orbital motion of the movable scroll, thereby compressing fluid drawn from the intake chamber in the compression chamber.

This electric compressor further includes a shaft support member and an elastic plate having a ring shape. The shaft support member is disposed facing the movable scroll on a side opposite to the fixed scroll, and supports the drive shaft. The elastic plate is interposed between the movable scroll and the shaft support member, and urges the movable scroll toward the fixed scroll. The air-tightness of the compression chamber is increased by urging the movable scroll toward the fixed scroll.

Further, in this electric compressor, the fixed scroll has an outer peripheral wall so as to fix the elastic plate. The outer peripheral wall extends from the outer periphery of an end surface of the fixed scroll base plate in a tubular shape so as to surround the fixed scroll wall. An outer peripheral portion of the elastic plate is held between an end surface of the outer peripheral wall and an end surface of the shaft support member.

The housing of the electric compressor includes a compression part housing surrounding the fixed scroll, a shaft support housing serving as the shaft support member, and a motor housing accommodating the electric motor. These housings are commonly fixed to each other with a plurality of fastening members extending in the axial direction of the drive shaft.

In order to respond to a demand for downsizing the electric compressor having the above-described configuration, a technique disclosed in Japanese Patent Application Publication No. 2019-178674 may be used.

In this technique, a compression part housing has, in a peripheral wall thereof, a plurality of thin-walled portions and a plurality of thick-walled portions disposed continuously with the thin-walled portions in a circumferential direction with respect to the drive shaft axis and projecting inwardly in a radial direction of the drive shaft axis, and a fastening member is inserted through each of the thick-walled portions. Additionally, a plurality of recesses extending in an axial direction of the drive shaft is formed at positions facing the thick-walled portions in a radial direction of the drive shaft in an outer peripheral surface of an outer peripheral wall of a fixed scroll. The recesses prevents the fixed scroll from interfering with the thick-walled portions. This configuration may suppress an increase of the dimension of the compression part housing in the radial direction due to the formation of the thick-walled portions to which the fastening members are inserted.

However, in order to mount the conventional electric compressor having the above-described configuration on a vehicle, for example, there may be a demand for further downsizing the electric compressor.

The present disclosure, which has been made in light of the above-mentioned problem, is directed to further downsizing a scroll type electric compressor.

SUMMARY

In accordance with an aspect of the present disclosure, there is provided an electric compressor including a housing, a drive shaft rotatably supported in the housing, an electric motor rotating the drive shaft, a fixed scroll fixed to the housing, the fixed scroll including a fixed scroll base plate and a fixed scroll wall extending from the fixed scroll base plate, a movable scroll connected to the drive shaft and supported in the housing so as to make an orbital motion around a drive shaft axis, the movable scroll including a movable scroll base plate facing the fixed scroll base plate and a movable scroll wall meshed with the fixed scroll wall, a compression chamber defined between the fixed scroll and the movable scroll, an elastic plate having a ring shape and urging the movable scroll toward the fixed scroll, the housing including a compression part housing that has a peripheral wall having a tubular shape and extending in the axial direction of the drive shaft so as to surround the fixed scroll, a shaft support housing that supports the drive shaft, and a motor housing that accommodates the electric motor, and a plurality of fastening members extending in the axial direction and fastening the compression part housing, the shaft support housing, and the motor housing to each other. The peripheral wall has a plurality of thick-walled portions that protrudes inwardly in a radial direction with respect to the drive shaft axis and through which their associated fastening members are inserted. The fixed scroll base plate has a plurality of protruded portions each protruding outwardly in the radial direction and disposed between the thick-walled portions in a circumferential direction with respect to the drive shaft axis. The fixed scroll base plate has a plurality of pillar portions each extending from the protruded portions toward the shaft support housing in the axial direction and spaced from each other at a predetermined intervals in the circumferential direction. The elastic plate is held at a plurality of spots by the plurality of pillar portions and the shaft support housing.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe an embodiment of the present disclosure with reference to the accompanying drawings.

Embodiment

Figure 1:
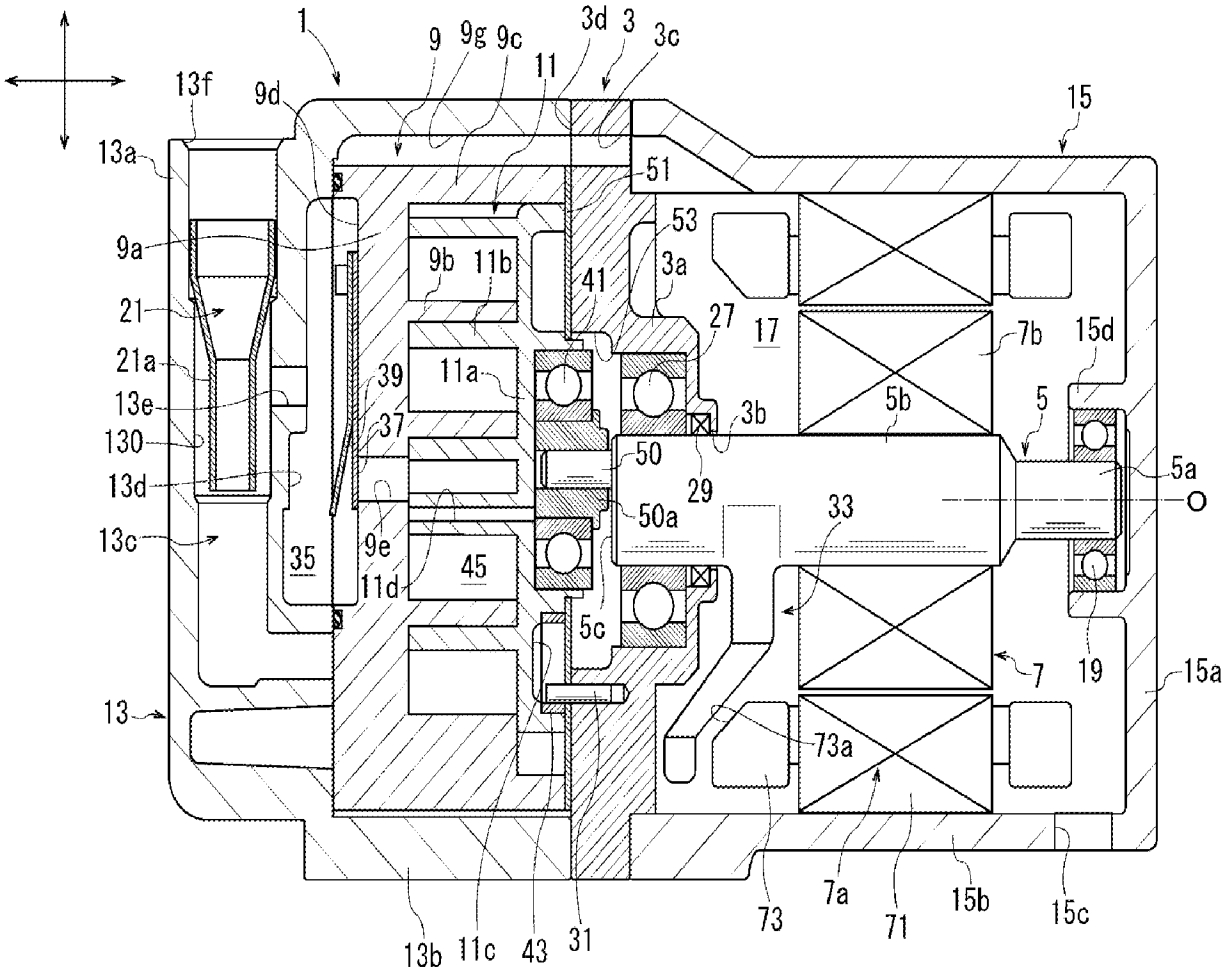
FIG. 1 is a cross-sectional view illustrating an electric compressor according to an embodiment.

An electric compressor (hereinafter simply referred to a compressor) of the present embodiment is used for an air conditioning device for a vehicle, as illustrated in FIG. 1. The compressor includes a housing 1, a drive shaft 5, an electric motor 7, a fixed scroll 9, a movable scroll 11, and an elastic plate 51. The housing 1 includes a shaft support housing 3, a compression part housing 13, and a motor housing 15.

As illustrated in FIG. 1, in the present embodiment, the front-rear direction of the compressor is defined by referring to the side on which the motor housing 15 is positioned as the front side of the compressor and referring to the side on which the compression part housing 13 is positioned as the rear side of the compressor. Further, the up-down direction of the compressor is defined by referring to the top of FIG. 1 as the upper side of the compressor and referring to the bottom of FIG. 1 as the lower side of the compressor. The directions such as the front-rear direction in the embodiment are merely examples, and the compressor of the present disclosure may be mounted appropriately in various postures depending on the vehicle on which the compressor is mounted. Additionally, in the present embodiment, the axial direction, the circumferential direction, and the radial direction are defined with respect to the drive shaft axis of the drive shaft 5.

The compression part housing 13 includes a rear wall 13*a* and a first peripheral wall 13*b*. The rear wall 13*a* is located at a rear end of the compression part housing 13, i.e., at a rear end of the housing 1, and extends in a radial direction of the compression part housing 13. The first peripheral wall 13*b* is connected to the rear wall 13*a* and extends frontward from the rear wall 13*a* in a direction of a drive shaft axis O. The rear wall 13*a* and the first peripheral wall 13*b* cooperate to form the compression part housing 13 having a bottomed-cylindrical shape. The drive shaft axis O extends in parallel to the front-rear direction of the compressor.

Figure 3:
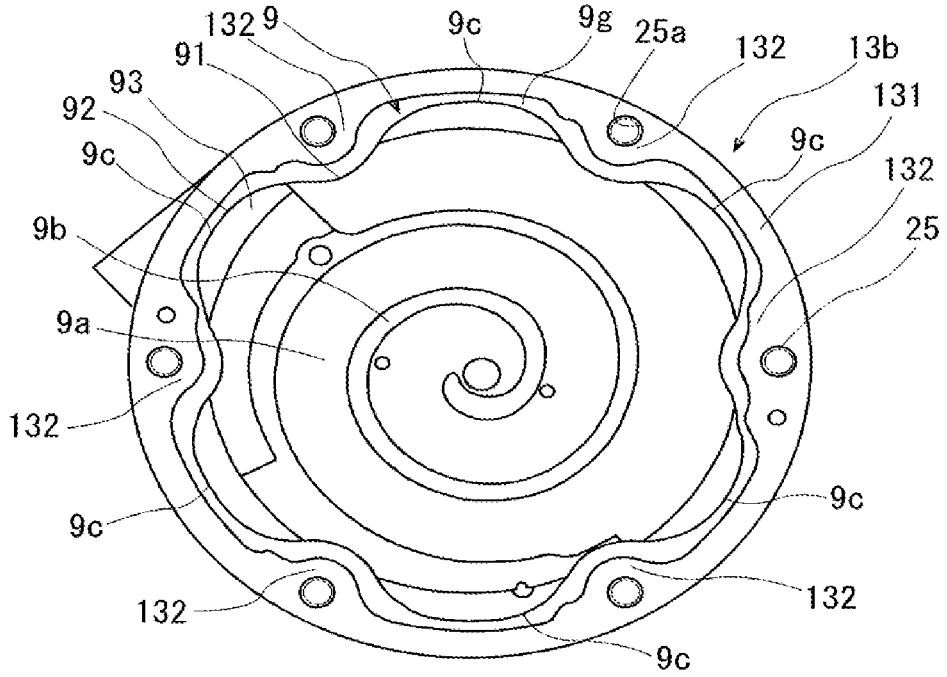
FIG. 3 is a plan view illustrating a compression part housing and the fixed scroll of the electric compressor according to the embodiment.

As illustrated in FIG. 3, the first peripheral wall 13*b* has a plurality of thin-walled portions 131, and a plurality of thick-walled portions 132. In the present embodiment, six thin-walled portions 131 and six thick-walled portions 132 are provided. The thin-walled portions 131 are disposed at regular angular intervals of 60 degrees in the circumferential direction of the compression part housing 13. Similarly, the thick-walled portions 132 are disposed at regular angular intervals of 60 degrees in the circumferential direction. The thin-walled portions 131 and the thick-walled portions 132 are arranged alternately in the circumferential direction.

The thick-walled portions 132 are disposed continuously with the thin-walled portions 131 in the circumferential direction with respect to an axis of the drive shaft 5, and protrude inwardly in the radial direction with respect to the axis of the drive shaft 5, so that the thicknesses of the thick-walled portion 132 are greater than those of the thin-walled portions 131. As illustrated in FIG. 3, the thick-walled portions 132 each has a bolt insertion hole 25*a* through which a bolt 25 as a fastening member is inserted. The lengths of the thin-walled portion 131 and the thick-walled portion 132 in the axial direction are slightly greater than that of the fixed scroll 9.

The compression part housing 13 has an oil separation chamber 13*c*, a first recessed portion 13*d*, a discharge passage 13*e*, and a discharge port 13*f*. The oil separation chamber 13*c* is located on a rear side in the compression part housing 13, and extends in the radial direction of the compression part housing 13. The first recessed portion 13*d* is located frontward relative to the oil separation chamber 13*c* in the compression part housing 13, and is recessed toward the oil separation chamber 13*c*. The discharge passage 13*e* extends in the direction of the drive shaft axis O, and is connected to the oil separation chamber 13*c* and the first recessed portion 13*d* in the compression part housing 13. The discharge port 13*f* is in communication with a top end of the oil separation chamber 13*c* and is opened to an outside of the compression part housing 13. The discharge port 13*f* is connected to a condenser (not illustrated).

A separation cylinder 21 is fixed to an inside of the oil separation chamber 13*c*. The separation cylinder 21 has an outer peripheral surface 21*a* having a cylindrical shape. The outer peripheral surface 21*a* is coaxial with an inner peripheral surface 130 of the oil separation chamber 13*c*. The outer peripheral surface 21*a* and the inner peripheral surface 130 cooperate to form a separator. A filter (not illustrated) is disposed below the oil separation cylinder 21 in the oil separation chamber 13*c*.

The motor housing 15 includes a front wall 15*a* and a second peripheral wall 15*b*. The front wall 15*a* is located at the front end of the motor housing 15, i.e., at the front end of the housing 1, and extends in a radial direction of the motor housing 15. The second peripheral wall 15*b* is connected to the front wall 15*a*, and extends rearward from the front wall 15*a* in the direction of the drive shaft axis O of the drive shaft 5. The front wall 15*a* and the second peripheral wall 15*b* cooperate to form the motor housing 15 having a bottomed-cylindrical shape. Further, the front wall 15*a* and the second peripheral wall 15*b* cooperate to define a motor chamber 17 in the motor housing 15.

The motor housing 15 has an intake port 15*c* and a support portion 15*d*. The intake port 15*c* is formed through the second peripheral wall 15*b*, and is in communication with the motor chamber 17. The intake port 15*c* is connected to an evaporator (not illustrated), and a refrigerant of fluid having passed through the evaporator is drawn into the motor chamber 17 through the intake port 15*c*. Thus, the motor chamber 17 also serves as an intake chamber. The support portion 15*d* projects from the front wall 15*a* into the motor chamber 17. The support portion 15*d* has a cylindrical shape, and a first radial bearing 19 is disposed in the support portion 15*d*. The intake port 15*c* may be formed through the front wall 15*a*. Six bolt insertion holes (not illustrated) are formed in the second peripheral wall 15*b* at positions corresponding to the bolt insertion holes 25*a* of the first peripheral wall 13*b* in the circumferential direction.

Figure 4:
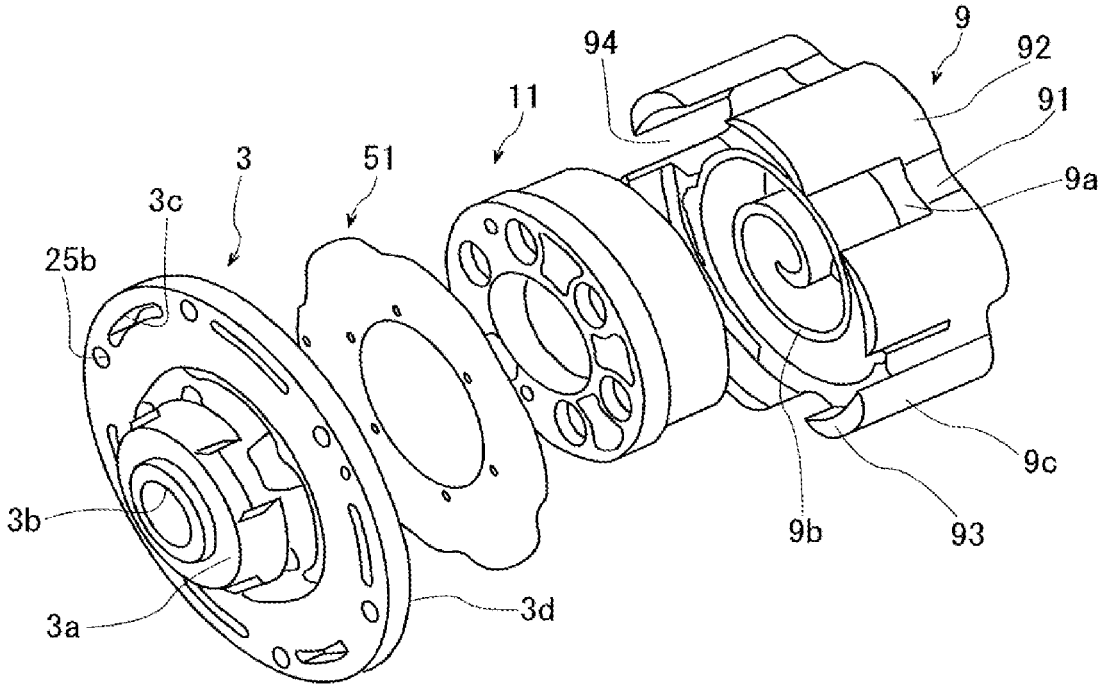
FIG. 4 is an exploded perspective view illustrating the fixed scroll, a movable scroll, an elastic plate, and a shaft support housing of the electric compressor according to the embodiment.
Figure 5:
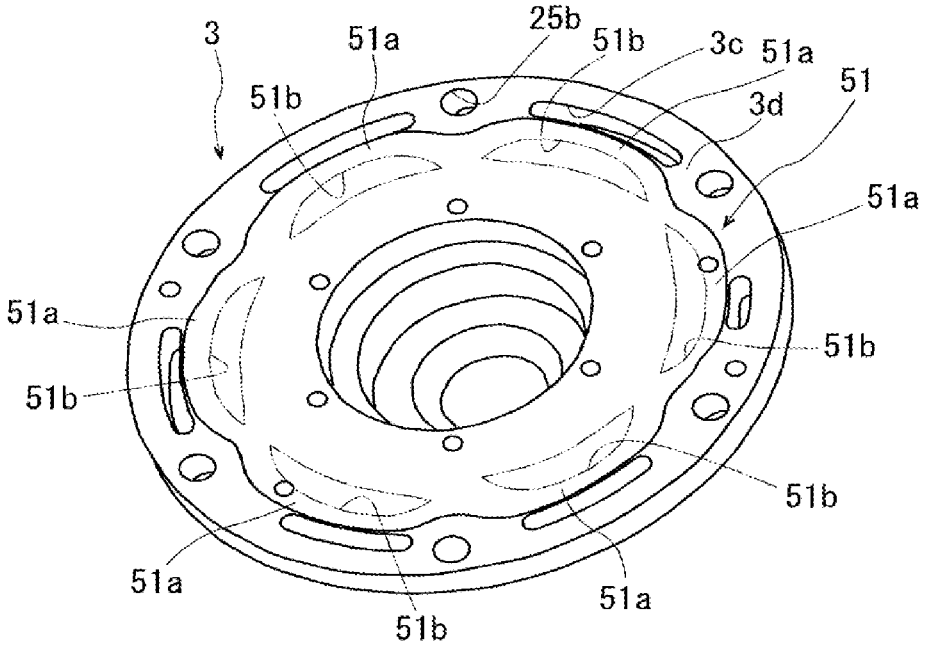
FIG. 5 is a perspective view of the elastic plate and the shaft support housing of the electric compressor according to the embodiment.

As illustrated in FIG. 1, the shaft support housing 3 is disposed between the motor housing 15 and the compression part housing 13. As illustrated in FIGS. 4 and 5, six bolt insertion holes 25*b* are also formed in an outer peripheral portion of the shaft support housing 3 at positions corresponding to the bolt insertion holes 25*a* of the first peripheral wall 13*b* in the circumferential direction. The compression part housing 13, the motor housing 15, and the shaft support housing 3 are fastened with a plurality of bolts 25 (six bolts 25 in the present embodiment) as the fastening members, from the compression part housing 13 side. In this way, the shaft support housing 3 is held between the compression part housing 13 and the motor housing 15, and fixed to the compression part housing 13 and the motor housing 15. That is, the compression part housing 13, the shaft support housing 3, and the motor housing 15 are fixed to each other with the plurality of bolts 25. The shaft support housing 3 is disposed between the electric motor 7 and the movable scroll 11. A method for fixing the shaft support housing 3 in the housing 1 may be changed depending on the design.

As illustrated in FIGS. 1 and 4, the shaft support housing 3 has a boss 3*a* projecting toward an inside of the motor chamber 17, and hence toward the electric motor 7. An insertion hole 3*b* is formed at a top end of the boss 3*a*. A second radial bearing 27 and a sealing member 29 are disposed in the boss 3*a*. A plurality of rotation prevention pins 31 is fixed to a rear surface of the shaft support housing 3. The rotation prevention pins 31 extend rearwardly from the shaft support housing 3. It is noted that only one of the plurality of the rotation prevention pins 31 is illustrated in FIG. 1. The shaft support housing 3 has a first intake passage 3*c* that extends through the shaft support housing 3 in the axial direction and is formed in the outer peripheral portion of the shaft support housing 3.

The drive shaft 5 has a cylindrical shape and extends in the direction of the drive shaft axis O. The drive shaft 5 has a small diameter portion 5*a* on a front end side thereof and a large diameter portion 5*b* on a rear end side thereof. An eccentric pin 50 is fixed to a rear end surface 5*c* of the large diameter portion 5*b*, which extends rearwardly from the rear end surface 5*c*. The eccentric pin 50 is disposed at a position eccentric from the drive shaft axis O in the rear end surface 5*c*.

As illustrated in FIG. 1, the drive shaft 5 is disposed in the housing 1. The small diameter portion 5*a* of the drive shaft 5 is rotatably supported by the support portion 15*d* of the motor housing 15 via the first radial bearing 19. The rear end of the large diameter portion 5*b* and the eccentric pin 50 are inserted into the boss 3*a* through the insertion hole 3*b* of the shaft support housing 3. The rear end of the large diameter portion 5*b* is rotatably supported by the second radial bearing 27 in the boss 3*a*. The drive shaft 5 is rotatable about the drive shaft axis O in the housing 1. The sealing member 29 seals a gap between the shaft support housing 3 and the drive shaft 5. The eccentric pin 50 is fitted in a bushing 50*a* in the boss 3*a*.

The drive shaft 5 includes a balance weight 33 formed integrally with the large diameter portion 5*b* of the drive shaft 5 and having a substantially fan shape of a plate. Specifically, the balance weight 33 is located on a side opposite to the eccentric pin 50 in the large diameter portion 5*b* with respect to the drive shaft axis O. The balance weight 33 extends from the large diameter portion 5*b* toward the second peripheral wall 15*b* between the shaft support housing 3 and the electric motor 7.

As illustrated in FIG. 1, the electric motor 7 is accommodated in the motor chamber 17, and located frontward relative to the balance weight 33. The electric motor 7 includes a stator 7*a*, and a rotor 7*b*. The stator 7*a* is fixed to the inner peripheral surface of the second peripheral wall 15*b* in the motor chamber 17. The stator 7*a* is connected to an inverter (not illustrated) that is disposed outside the motor housing 15.

The stator 7*a* includes a stator core 71 having a cylindrical shape and a coil end 73 having an annular shape and extending forward and rearward from the stator core 71 in the axial direction. The coil end 73 has an inner peripheral surface 73*a*, and a rear side of the inner peripheral surface 73*a* is inclined so as not to interfere with the balance weight 33.

As illustrated in FIG. 1, the rotor 7*b* is disposed inside the stator 7*a*, and is fixed to the large diameter portion 5*b* of the drive shaft 5. The rotor 7*b* rotates inside the stator 7*a*, which rotates the drive shaft 5 about the drive shaft axis O.

The fixed scroll 9 is fixed to the compression part housing 13, and is disposed on a radially inward side of the first peripheral wall 13*b*. The fixed scroll 9 includes a fixed scroll base plate 9*a*, a fixed scroll wall 9*b*, and a plurality of pillar portions 9*c* (six pillar portions in the present embodiment). The fixed scroll base plate 9*a* is located at a rear end of the fixed scroll 9 and has a disc shape. The fixed scroll base plate 9*a* has a second recessed portion 9*d* and a discharge port 9*e*. The second recessed portion 9*d* is formed in a rear end surface of the fixed scroll base plate 9*a* and is recessed forward. The second recessed portion 9*d* faces the first recessed portion 13*d* with the fixed scroll 9 fixed to the compression part housing 13. The first recessed portion 13*d* and the second recessed portion 9*d* cooperate to form a discharge chamber 35. The discharge chamber 35 is in communication with the oil separation chamber 13*c* through the discharge passage 13*e*. The discharge port 9*e* extends through the fixed scroll base plate 9*a* in the direction of the drive shaft axis O, and is in communication with the second recessed portion 9*d* and hence the discharge chamber 35.

A discharge reed valve 37 and a retainer 39 are attached to the fixed scroll base plate 9*a*. The discharge reed valve 37 and the retainer 39 are disposed inside the discharge chamber 35. The discharge reed valve 37 elastically deforms to open and close the discharge port 9*e*. The retainer 39 regulates an elastic deformation amount of the discharge reed valve 37.

Figure 2:
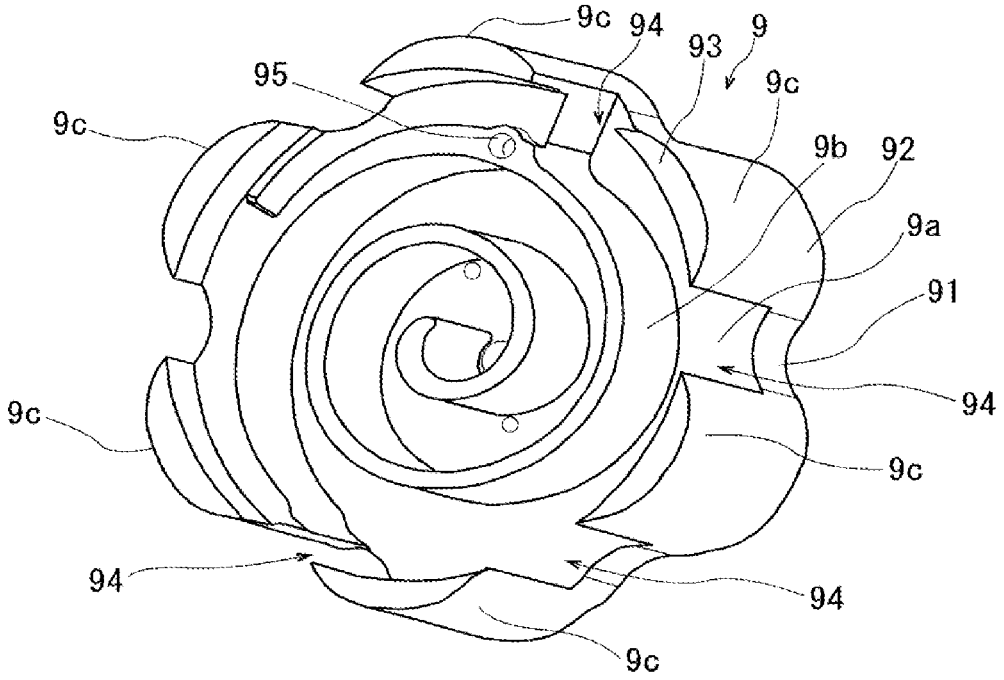
FIG. 2 is a perspective view of a fixed scroll of the electric compressor according to the embodiment.

As illustrated in FIGS. 2 and 3, a plurality of recessed portions 91 and a plurality of protruded portions 92 are formed in the outer peripheral surface of the fixed scroll base plate 9*a*. Each of the number of the recessed portions 91 and the number of the protruded portions 92 is six in the present embodiment. The recessed portions 91 are disposed at regular angular intervals of 60 degrees in the circumferential direction. Similarly, the protruded portions 92 are disposed at regular angular intervals of 60 degrees in the circumferential direction. The recessed portions 91 and the protruded portions 92 are alternately disposed in the circumferential direction. The recessed portions 91 and the protruded portions 92 extend in the entire thickness direction of the fixed scroll base plate 9*a*.

The recessed portions 91 are disposed at positions facing the thick-walled portions 132 of the first peripheral wall 13*b*, respectively, in the radial direction. The recessed portions 91 each have an outer surface on radially outward side that is a recessed curved surface having an arc shape. Spaces are formed between the outer surfaces of the recessed portions 91 and inner surfaces of their associated thick-walled portion 132 of the first peripheral wall 13*b* on the radially inward side thereof. As a result, interference between the recessed portions 91 of the fixed scroll base plate 9*a* and their associated thick-walled portions 132 of the first peripheral wall 13*b* is avoided.

The protruded portions 92 are disposed at positions facing the thin-walled portions 131 of the first peripheral wall 13*b*, respectively, in the radial direction. The protruded portions 92 protrude radially outward relative to the recessed portions 91. The protruded portions 92 each have an outer surface on the radially outward side that is a projected curved surface having an arc shape. Spaces are formed between the outer surfaces of the protruded portions 92 and inner surfaces of their associated thin-walled portions 131 of the first peripheral wall 13*b* on the radially inward side thereof. The protruded portions 92 are positioned between two of the thick-walled portions 132 disposed next to each other in the circumferential direction.

The fixed scroll 9 has the plurality of pillar portions 9*c*, each extending in the axial direction from the protruded portions 92 toward the shaft support housing 3 positioned on the front side of the compressor. In the present embodiment, six pillar portions 9*c* are provided. An outer surface of each of the pillar portions 9*c* on radially outward side thereof is a projected curved surface having an arc shape, similarly to the protruded portions 92. The projected curved surfaces of the protruded portions 92 and the projected curved surfaces of the pillar portions 9*c* have the same shape, and are disposed continuously in the axial direction and flush with each other. Thus, spaces are also formed between the outer surfaces of the pillar portions 9*c* and the inner surfaces of the thin-walled portions 131 of the first peripheral wall 13*b* on the radially inward sides thereof. An end surface 93 of each of the pillar portions 9*c* in the axial direction is a flat surface having a crescent shape.

As illustrated in FIG. 2, the six pillar portions 9*c*, namely, the first pillar, the second pillar, the third pillar, the fourth pillar, the fifth pillar, and the sixth pillar, are spaced form each other at predetermined intervals in the circumferential direction, and four empty portions 94 are formed between the first to fifth pillar portions 9*c* of the six pillar portions 9*c*. Specifically, the four empty portions 94 are formed between the first pillar portion 9*c* and the second pillar portion 9*c*, between the second pillar portion 9*c* and the third pillar portion 9*c*, between the third pillar portion 9*c* and the fourth pillar portion 9*c*, and between the fourth pillar portion 9*c* and the fifth pillar portion 9*c*. The four empty portions 94 are disposed at regular angular intervals of 60 degrees in the circumferential direction. The four empty portions 94 extend in the axial direction from the front end surface of the fixed scroll base plate 9*a* to the end surfaces 93 of the pillar portions 9*c*. The axial lengths of the pillar portions 9*c* and the empty portions 94 are the same.

The empty portions 94 provide communication between the radially outer side of the fixed scroll 9 and the radially inward side of the pillar portions 9*c*. A second intake passage 9*g* is formed by a gap between the outer peripheral surface of the fixed scroll 9 and the inner peripheral surface of the first peripheral wall 13*b*. The second intake passage 9*g* is in communication with the first intake passage 3*c* of the shaft support housing 3. Thus, the empty portions 94 are in communication with the motor chamber 17 through the second intake passage 9*g* and the first intake passage 3*c*.

The fixed scroll wall 9*b* extends from the front surface of the fixed scroll base plate 9*a*, and are disposed on the radially inward side of the pillar portions 9*c*. The fixed scroll base plate 9*a*, the fixed scroll wall 9*b*, and the pillar portions 9*c* are formed integrally.

As illustrated in FIG. 2, an oil supply passage 95 is formed in the fixed scroll 9. The oil supply passage 95 extends through the fixed scroll base plate 9*a* and the fixed scroll wall 9*b*. Thus, a rear end of the oil supply passage 95 is opened in the rear end surface of the fixed scroll base plate 9*a* and a front end of the oil supply passage 95 is opened in the front end surface of the fixed scroll wall 9*b*. The oil supply passage 95 is connected to the oil separation chamber 13*c* via a filter (not illustrated). The shape of the oil supply passage 95 may be changed depending on the design.

The movable scroll 11 is disposed in the compression part housing 13, and is located between the fixed scroll 9 and the shaft support housing 3. The movable scroll 11 includes a movable scroll base plate 11*a* and a movable scroll wall 11*b*. The movable scroll base plate 11*a* is located at a front end of the movable scroll 11 and has a disc shape. The movable scroll base plate 11*a* supports a bushing 50*a* via a third radial bearing 41. Thus, the movable scroll 11 is connected to the drive shaft 5 via the bushing 50*a* and the eccentric pin 50 at a position eccentric from the drive shaft axis O.

The movable scroll base plate 11*a* has rotation prevention holes 11*c* to which distal ends of the rotation prevention pins 31 are loosely fitted. Rings 43 each having a cylindrical shape are loosely fitted in the rotation prevention holes 11*c*.

The movable scroll wall 11*b* extends from a front surface of the movable scroll base plate 11*a* toward the fixed scroll base plate 9*a*. The movable scroll wall 11*b* has, in a vicinity of the center of the movable scroll wall 11*b* in the radial direction, an air supply hole 11*d* that is opened at a front end of the movable scroll wall 11*b* and extends in the front-rear direction through the movable scroll wall 11*b* to the movable scroll base plate 11*a*.

The fixed scroll 9 and the movable scroll 11 mesh with each other. Thus, a compression chamber 45 is formed between the fixed scroll 9 and the movable scroll 11. The compression chamber 45 is defined by the fixed scroll base plate 9*a*, the fixed scroll wall 9*b*, the movable scroll base plate 11*a*, and the movable scroll wall 11*b*. The compression chamber 45 is in communication with the discharge port 9*e* through which the compression chamber 45 is in communication with the discharge chamber 35. Further, the compression chamber 45 is in communication with the empty portions 94. The compression chamber 45 is in communication with the motor chamber 17 serving as the intake chamber through the empty portions 94, the second intake passage 9*g*, and the first intake passage 3*c*. That is, each of the empty portions 94 serves as an intake port through which refrigerant is introduced to the compression chamber 45.

The elastic plate 51 is disposed between the shaft support housing 3, and the fixed scroll 9 and the movable scroll 11. As illustrated in FIG. 5, the elastic plate 51 has a plurality of expanded portions 51*a* (six expanded portions 51 in the present embodiment), projecting radially outwardly in an outer peripheral portion of the elastic plate 51. The expanded portions 51*a* are disposed at regular angular intervals of 60 degrees in the circumferential direction. An outer peripheral portion of the elastic plate 51 is held between the end surfaces 93 of the pillar portions 9*c* of the fixed scroll 9 and the rear end surface 3*d* of the shaft support housing 3. That is, the expanded portions 51*a* are held between the end surfaces 93 of the pillar portions 9*c* and the rear end surface 3*d* of the shaft support housing 3 with the end surfaces 93 of the pillar portions 9*c* in contact with parts of the expanded portions 51*a* (the parts 51*b* indicated by the double-dotted chain line in FIG. 5). Although the movable scroll 11 is in contact with the elastic plate 51, the elastic plate 51 is not held between the movable scroll 11 and the shaft support housing 3. The elastic plate 51 is made of a thin metal sheet. The movable scroll 11 is urged toward the fixed scroll 9 by the elastic restoring force of the elastic plate 51.

The movable scroll base plate 11*a* and the elastic plate 51 cooperate to form a backpressure chamber 53 in the boss 3*a* of the shaft support housing 3. The backpressure chamber 53 is in communication with the air supply hole 11*d*.

In this compressor, the drive shaft 5 rotates about the drive shaft axis O with the electric motor 7 controlled and driven by the inverter. This rotates the movable scroll 11, which allows the movable scroll base plate 11*a* to slide on a distal end of the fixed scroll wall 9*c*, and the fixed scroll wall 9*c* and the movable scroll wall 11*b* to slide on each other. At this time, each of the rotation prevention pins 31 rotates in its associated ring 43 while sliding on an inner peripheral surface of the ring 43, which prevents the movable scroll 11 from rotating on its own axis and allows the movable scroll 11 to make an orbital motion around the drive shaft axis O. The orbital motion of the movable scroll 11 allows refrigerant introduced into the motor chamber 17 from the intake port 15*c* to be drawn into the compression chamber 45 through the first intake passage 3*c*, the second intake passage 9*g*, and the empty portions 94. Thus, the compression chamber 45 reduces its volume and compresses the refrigerant inside the compression chamber 45 with the orbital motion of the movable scroll 11. The empty portions 94 each corresponds to a space between the pillar portions 9*c* through which fluid is drawn into the compression chamber 45.

In this compressor, the air supply hole 11*d* is slightly opened to the compression chamber 45 with the orbital motion of the movable scroll 11. This allows part of the refrigerant at high pressure in the compression chamber 45 to flow into the backpressure chamber 53 through the air supply hole 11*d*, which increases the pressure in the backpressure chamber 53. In this compressor, the movable scroll 11 is urged toward the fixed scroll 9 by the elastic plate 51 and the pressure of the backpressure chamber 53, so that the compression chamber 45 is sealed suitably.

The high-pressure refrigerant compressed in the compression chamber 45 is discharged from the discharge port 9*e* to the discharge chamber 35, and further flows out from the discharge chamber 35 to the oil separation chamber 13*c* through the discharge passage 13*e*. The high-pressure refrigerant swirls between the outer peripheral surface 21*a* of the separation cylinder 21 and the inner peripheral surface 130 of the oil separation chamber 13*c* while lubricant oil is separated therefrom, and flows through an inside of the separation cylinder 21 to be discharged from the discharge port 13*f*.

On the other hand, the lubricant oil separated from the refrigerant is stored in the oil separation chamber 13*c*. The lubricant oil flows through the oil supply passage 95 via the filter (not illustrated), and is supplied to sliding parts between the fixed scroll 9 and the movable scroll 11. Thus, the sliding parts between the fixed scroll 9 and the movable scroll 11 are lubricated. In addition, the lubricant oil flowing though the oil supply passage 95 is also supplied to the motor chamber 17, in addition to a part between the second radial bearing 27 and the drive shaft 5.

In this compressor, the compression part housing 13, the shaft support housing 3, and the motor housing 15 are fixed to each other with the plurality of bolts 25. The compression part housing 13 includes the first peripheral wall 13*b* having a tubular shape, and the fixed scroll 9 is disposed in the first peripheral wall 13*b*. The first peripheral wall 13*b* of the compression part housing 13 has the plurality of thin-walled portions 131, and the plurality of thick-walled portions 132 through which the bolts 25 are inserted. The plurality of recessed portions 91 is formed in the outer peripheral surface of the fixed scroll base plate 9*a* at the positions facing the thick-walled portions 132 in the radial direction so as not to interfere with the thick-walled portions 132. The plurality of protruded portions 92 is formed in the outer peripheral surface of the fixed scroll base plate 9*a* at the positions facing the thin-walled portions 131, and the protruded portions 92 projects radially outward relative to the recessed portions 91. That is, each of the protruded portions 92 is disposed between two adjacently disposed thick-walled portions 132 in the circumferential direction. The fixed scroll 9 has the plurality of pillar portions 9*c* extending from the protruded portions 92 toward the shaft support housing 3, and the fixed scroll 9 and the shaft support housing 3 cooperate to hold therebetween the elastic plate 51.

This compressor has a configuration in which the above-mentioned conventional electric compressor is modified so that an outer peripheral wall of the fixed scroll having a tubular shape is recessed at positions corresponding to the thick-walled portions 132 of the compression part housing 13. Thus, the thick-walled portions 132 of the compression part housing 13 may be disposed closer in the radial direction by an amount of the recessed outer peripheral wall, and the outer diameter of the first peripheral wall 13*b* may be made small. As a result, enlargement of the diameter of the first peripheral wall 13*b* of the compression part housing 13 due to the provision of the thick-walled portions 132 for inserting the bolts 25 may be further suppressed.

Therefore, the compressor having the configuration of the present embodiment in which the elastic plate 51 urging the movable scroll 11 toward the fixed scroll 9 is held by the fixed scroll 9 and the shaft support housing 3, and the compression part housing 13 accommodating the fixed scroll 9, the shaft support housing 3, and the motor housing 15 are fastened with the bolts 25 may be further downsized. Additionally, the weight of the compressor may be reduced.

In this compressor, the fixed scroll 9 has four empty portion 94 positioned adjacently to the pillar portions 9*c* in the circumferential direction. Each of the empty portions 94 is in communication with the intake port 15*c* through the second intake passage 9*g*, the first intake passage 3*c*, and the motor chamber 17. In this case, refrigerant from the intake port 15*c* is introduced to the compression chamber 95 through the four empty portions 94, so that the intake efficiency of the refrigerant may be increased. Since a cross sectional area of openings of the empty portions 94 is larger than that of an intake port of the conventional fixed scroll, the intake efficiency may be further increased.

In this compressor, the expanded portions 51*a* of the elastic plate 51 are held between the six pillar portions 9*c* of the fixed scroll 9 and the shaft support housing 3. That is, the outer peripheral portion of the elastic plate 51 is held at a plurality of spots at predetermined intervals in the circumferential direction by the pillar portions 9*c* and the shaft support housing 3. This allows the elastic plate 51 to deform easily in a waved shape in the circumferential direction. As a result, a space is likely to be formed between the elastic plate 51 and the shaft support housing 3, especially, on the inner peripheral side of the elastic plate 51. Since this space is in communication with the backpressure chamber 53, a backpressure from the backpressure chamber 53 may be applied to the front surface of the elastic plate 51 through this space. Thus, a backpressure supply groove need not be formed in the rear end surface 3*d* of the shaft support housing 3, so that the manufacturing process of the shaft support housing 3 may be simplified. The predetermined intervals between the first to six pillar portions 9*c* are appropriately determined for each of models of the compressors depending on a force to hold the elastic plate 51 and a supply amount of the backpressure that are required.

Although the present disclosure has been described based on the above embodiment, the present disclosure is not limited to the above embodiment, but may be modified within the scope of the present disclosure.

For example, although the number of the bolts 25 as the fastening members, the number of the thick-walled portions 132 of the first peripheral wall 13*b*, the number of the pillar portions 9*c*, and the like are 6 in the above embodiment, the numbers of these parts may be changed as required. In addition, in the compressor of the above-described embodiment, although the outer peripheral surface of the shaft support housing 3 is exposed to an outside of the compressor, the outer peripheral surface of the shaft support housing 3 may be accommodated in the motor housing 15 completely.

The present invention may be applicable to an air conditioning device for a vehicle and the like.

What is claimed is:

1. An electric compressor comprising:

a housing;

a drive shaft rotatably supported in the housing;

an electric motor rotating the drive shaft;

a fixed scroll fixed to the housing, the fixed scroll including a fixed scroll base plate and a fixed scroll wall extending from the fixed scroll base plate;

a movable scroll connected to the drive shaft and supported in the housing so as to make an orbital motion around a drive shaft axis, the movable scroll including a movable scroll base plate facing the fixed scroll base plate and a movable scroll wall meshed with the fixed scroll wall;

a compression chamber defined between the fixed scroll and the movable scroll;

an elastic plate having a ring shape and urging the movable scroll toward the fixed scroll;

the housing including a compression part housing that has a peripheral wall having a tubular shape and extending in the axial direction of the drive shaft so as to surround the fixed scroll, a shaft support housing that supports the drive shaft, and a motor housing that accommodates the electric motor; and a plurality of fastening members extending in the axial direction and fastening the compression part housing, the shaft support housing, and the motor housing to each other, wherein the peripheral wall has a plurality of thick-walled portions that protrudes inwardly in a radial direction with respect to the drive shaft axis and through which associated ones of the fastening members are inserted, the fixed scroll base plate has a plurality of protruded portions each protruding outwardly in the radial direction and disposed between the thick-walled portions in a circumferential direction with respect to the drive shaft axis, the fixed scroll base plate has a plurality of pillar portions each extending from the protruded portions toward the shaft support housing in the axial direction and spaced from each other at a predetermined interval in the circumferential direction, and the elastic plate is held at a plurality of spots by the plurality of pillar portions and the shaft support housing, an empty portion having a rectangular shape is formed between the plurality of pillar portions, the empty portion extends in the axial direction from a front end surface of the fixed scroll base plate to end surfaces of the plurality of pillar portions, a plurality of recessed portions and the plurality of protruded portions are formed in an outer peripheral surface of the fixed scroll base plate, the plurality of recessed portions and the plurality of protruded portions are alternately disposed in the circumferential direction, the plurality of recessed portions are disposed at positions facing the thick-walled portions of the peripheral wall in the radial direction, the plurality of recessed portions each have an outer surface on a radially outward side that is a recessed curved surface having an arc shape, and the plurality of recessed portions are recessed radially inward relative to a radially inward side of an inner surface of the pillar portion.

2. The electric compressor according to claim 1, wherein fluid is drawn into the compression chamber through a space between at least two of the pillar portions.

* * * * *